US009474311B2

(12) United States Patent
Short

(10) Patent No.: US 9,474,311 B2
(45) Date of Patent: Oct. 25, 2016

(54) ZIPPERED UPPER-BODY GARMENT WITH DUAL PURPOSE POCKETS

(71) Applicant: Daniel R. Short, Norfolk, VA (US)

(72) Inventor: Daniel R. Short, Norfolk, VA (US)

( * ) Notice: Subject to any disclaimer, the term of this patent is extended or adjusted under 35 U.S.C. 154(b) by 0 days.

(21) Appl. No.: 14/835,051

(22) Filed: Aug. 25, 2015

(65) Prior Publication Data

US 2016/0073716 A1 Mar. 17, 2016

Related U.S. Application Data

(60) Provisional application No. 62/050,362, filed on Sep. 15, 2014.

(51) Int. Cl.
*A41D 27/20* (2006.01)

(52) U.S. Cl.
CPC ..... *A41D 27/20* (2013.01)

(58) Field of Classification Search
CPC .... A41D 27/20; A41D 1/02; A41D 13/0012; A41B 1/00
USPC ..... 2/247, 93, 94, 114, 115, 105, 108
See application file for complete search history.

(56) References Cited

U.S. PATENT DOCUMENTS 1,605,817 A * 11/1926 Dozer ..... A01D 46/22 2/69.5
4,773,102 A 9/1988 Curtis et al.
4,882,786 A * 11/1989 Gross ..... A41D 13/0012 2/102
6,199,210 B1 3/2001 Feldman
6,314,580 B1 * 11/2001 Greenberg ..... A41D 13/1245 2/108
6,996,847 B2 * 2/2006 Anderson ..... A41D 3/02 2/158
7,779,486 B2 8/2010 Tomlinson et al.
8,424,114 B2 4/2013 Snyder et al.
2009/0158493 A1 6/2009 Kim
2010/0299800 A1 12/2010 Jackson, Jr.
2014/0259296 A1 9/2014 Asnis et al.

* cited by examiner

*Primary Examiner* — Tejash Patel
(74) *Attorney, Agent, or Firm* — William G. Sykes

(57) ABSTRACT

An upper body garment having one or more pocket-like openings in an outer layer allowing access to an inner surface of the garment or an inside garment of a wearer of the upper body garment. Such access openings are referred to as "open bottom pockets". These open bottom pockets are typically formed in addition to normal pockets, however, in some embodiments, the open bottom pockets may replace normal pockets. Representative examples of upper body garments with which the novel open bottom pockets may be useful include, but are not limited to, coats, jackets sweaters (particularly pullover style sweaters), sweatshirts, or any other similar upper body garments. When the upper body garment is an open front upper body garment, a zipper, preferably a nylon zipper may be included. A nylon zipper minimizes damage to a surface against which a wearer of the upper body garment may contact.

9 Claims, 3 Drawing Sheets

ZIPPERED UPPER-BODY GARMENT WITH DUAL PURPOSE POCKETS

RELATED APPLICATIONS

This application claims priority in accordance with 37 C.F.R. ¶1.19(e) to U.S. Provisional Patent Application Ser. No. 62/050,362 filed Sep. 15, 2014 for ZIPPERED UPPER-BODY GARMENT WITH DUAL PURPOSE POCKETS which is included herein in its entirety by reference.

FIELD OF THE INVENTION

The invention pertains to upper body garments such as coats, jackets, sweaters, shirts, sweat shirts and the like and, more particularly, to upper body garments having at least one pocket-like opening in an external surface allowing a wearer to access an inside surface of the garment through such pocket-like openings.

BACKGROUND OF THE INVENTION

There are numerous reasons why accessibility to an inner surface of an upper body garment from outside the garment may be advantageous.

In one scenario, additional pockets may be placed on an inside surface of the upper body garment. If the upper body garment is secured with a standard front fastener such as a zipper, such pockets may be accessed without the need for opening the front of the garment (i.e., unzipping the garment). In severe climate conditions, such access may be greatly advantageous to the wearer. If the upper body garment is a "pullover" style garment without an openable front, the access to such pockets on and inside surface of the upper garment is all the more advantageous.

Such access to an inside surface of an upper body garment would also allow access to pockets on an inside garment under the upper body garment. This would allow, for example, a wearer to remover a cell phone or the like from a shirt pocket of an inside garment without opening the front of the upper body garment.

It would, therefore, be advantageous to provide an upper body garment having one or more pocket-like openings in an external surface of the garment that allow a wearer of the garment access to an inside surface of the garment.

DISCUSSION OF THE RELATED ART

Several attempts to provide to access to an inner surface of an upper body garment may be found in the prior art. For example, U.S. Pat. No. 4,773,102 for INNER-POCKETED TWO PERSON JACKET issued Sep. 27, 1988 to Darryl A. Curtis et al. provides an outer garment to be worn by two persons together, consisting of a vest, two sleeves and two inner arm support compartments. The garment can be a closed vest having a means of access for the head at the top, or having a front opening extending from top to bottom, having a first section and a second section with a means of closure. The inner arm support compartments afford the wearers comfort and wearing versatility, while allowing the two wearers to maintain close physical contact.

U.S. Pat. No. 6,199,210 for GARMENT DECORATION issued Mar. 13, 2001 to Michael S. Feldman teaches a garment comprising an outer layer, which has an outer surface and an inner surface, and an inner layer, which is attached to the outer layer, has a slit defined by two opposite margins. The garment comprises a fastener, such as a zipper or a hook-and-loop fastener, which is manipulatable to unfasten the opposite margins from each other and to refasten the opposite margins to each other. The slit provides access to the inner surface of the outer layer, when the opposite margins are unfastened from each other, so that a decoration can be stitched onto the outer surface of the outer layer, through the inner surface of the outer layer, without stitching through the inner layer.

U.S. Pat. No. 7,779,486 for GARMENT WITH UNDER-ARM EXTERNALLY ACCESSIBLE BREAST POCKETS AND METHOD OF USE issued Aug. 24, 2010 to Jodi Tomlinson et al. provides a garment with underarm externally accessible breast pockets and method of use. An upper body garment is disclosed having garment sleeves attached to a garment trunk, and a pocket mouth disposed under each garment sleeve. A pocket is attached to the garment trunk at each pocket mouth. A passenger positioned behind a driver wearing the upper body garment may insert hands and arms through the pocket mouths and into the pockets for warmth, security, and or intimacy enhancement. The pockets may terminate in conventional pocket shape, mitten shape, or glove shape, which latter two embodiments permit gripping of thumb lobes, major lobes, and/or finger lobes between the passenger thumbs and fingers, thus increasing passenger security. In another embodiment, non-slip material may be attached inside the pockets for increased passenger security. A method of use is disclosed wherein a passenger seated behind a driver inserts hands and arms into the pockets.

U.S. Pat. No. 8,424,114 for CONVERTIBLE GARMENT issued Apr. 23, 2013 to Brian T. Snyder teaches a convertible garment that is reconfigurable from a garment to a neck pillow. The neck pillow may be generally U-shaped to fit about the neck of a wearer. The garment may include a pocket generally corresponding in shape to desired shape of the neck pillow. The pocket is of sufficient size to receive the remainder of the garment so that the remainder of the garment can be inserted into the pocket. The pocket may be sized so that the remainder of the garment substantially fills the pocket, thereby providing a relatively firm neck pillow capable of providing the desired level of neck support. The pocket may have a closure, such as a zipper, to retain the remainder of the garment in the pocket. The garment may be a jacket with the pocket located in the lower back that opens to the inside of the garment. The pocket may be manufactured from or lined with a soft material, such as a brushed tricot or a fleece.

United States Published Patent Application No. 2009/0158493 for JACKET HAVING WARM POCKET published Jun. 25, 2009 upon application by Eun Hee Kim discloses a jacket having a warm pocket capable of warming hands of a user without interrupting user's activity in the field. The jacket has a dual-layer structure of an inner skin and an outer skin so as to accommodate a wearer therein. A pocket is formed at a front part or a rear part of the jacket by sewing the inner skin with the outer skin in the form of a pocket. The pocket is formed at both sides thereof with openings so as to allow a user to put both hands into the pocket. An inner pocket formed at one side thereof with a hand warmer receiving section is coupled to an outer surface of the inner skin.

United States Published Patent Application No. 2010/0299800 for HAND WARMER WITH VIEWING WINDOW FOR MEDIA DEVICE published Dec. 2, 2010 upon application by Loyd E. Jackson, J R. discloses a hand warmer that allows a media device, such as a cell phone, personal digital assistant, music player, or gaming device to be viewed and manipulated by a user while the user holds the media device with one or both hands within the hand warmer. The user is thus able to keep his or her hands and the media device warm and dry and otherwise protected from the elements while operating the media device.

United States Published Patent Application No. 2014/0259296 for ATHLETIC GARMENT WITH INTEGRATED HANGING POCKET published Sep. 18, 2014 upon application by SPECIALIZED BICYCLE COMPONENTS, INC. shows an athletic garment comprising a garment configured to snugly fit a torso wherein the garment has a front portion and a rear portion. The athletic garment further comprises a pocket secured to the rear portion of the garment providing a pocket for containing items therein. The pocket comprises a secured portion and a hanging portion wherein the secured portion is secured to the garment and the hanging portion is not secured to the garment.

None of the patents and published patent applications, taken singly, or in any combination are seen to teach or suggest the Zippered Upper-Body Garment with Dual Purpose Pockets of the present invention.

SUMMARY OF THE INVENTION

In accordance with the present invention there is provided an upper body garment having one or more pocket-like openings in an outer layer thereof. However, these openings have no bottom structure as is found in normal pockets. Rather, these openings allow access to an inner surface of the garment or the inside garment of a wearer of the upper body garment. As used herein, such access openings are referred to hereinafter as "open bottom pockets"

These open bottom pockets are typically formed in addition to normal pockets, however, in some embodiments, the open bottom pockets may replace normal pockets. Representative examples of upper body garments with which the novel open bottom pockets may be useful include, but are not limited to, coats, jackets sweaters (particularly pullover style sweaters), sweatshirts, or any other similar upper body garments.

BRIEF DESCRIPTION OF THE DRAWINGS

Various objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENT

The present invention provides upper body garments having one or more open bottom pockets that allow the hand of a garment wearer to place his or her hands into the external openings of the open bottom pockets and access either the inner surface of the upper body garment or objects or areas in proximity to the inner openings of the open bottom pockets.

Figure 1:
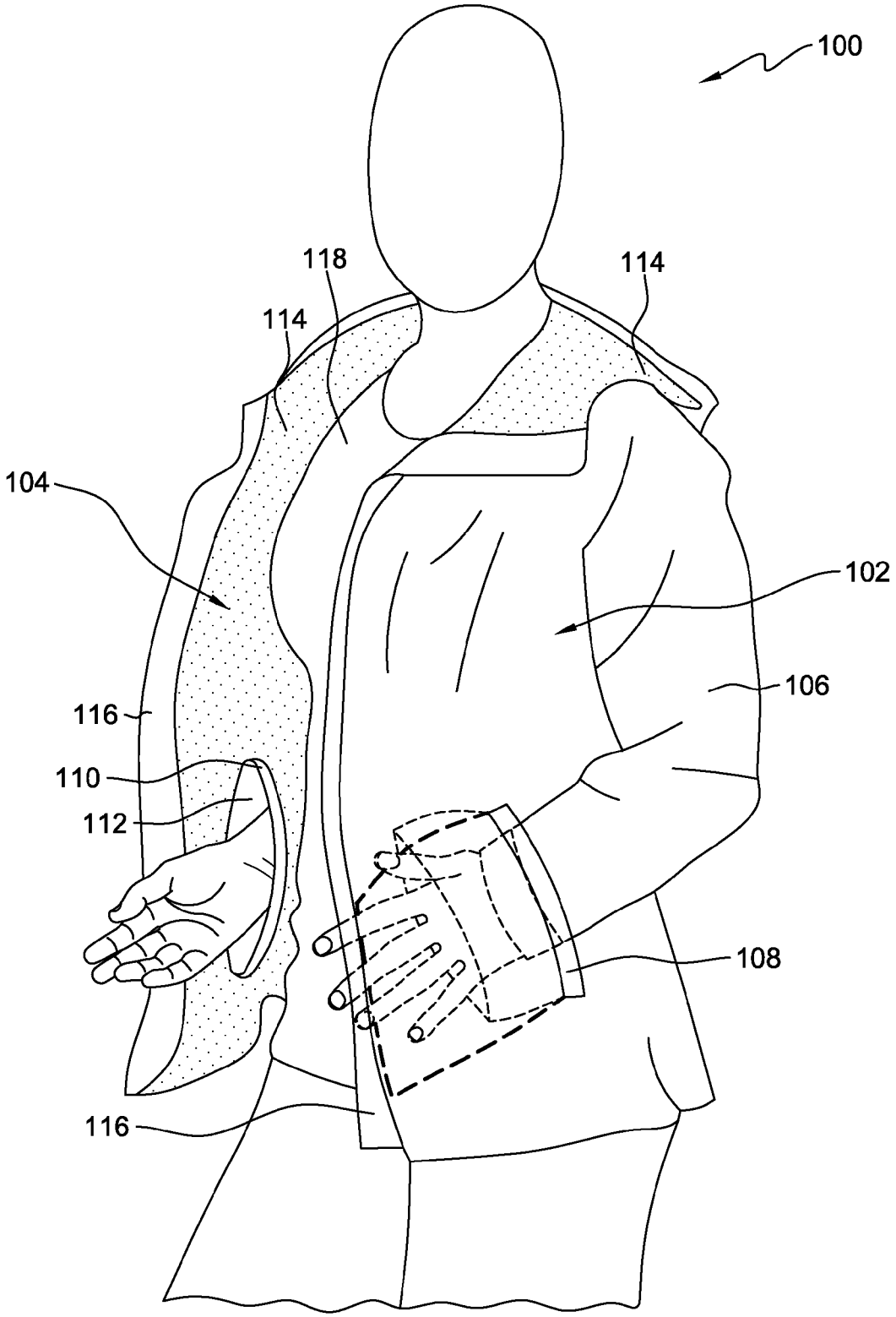
FIG. 1 is a right front perspective, schematic view of the upper body garment in accordance with the invention disposed on a wearer thereof.

Referring first to FIG. 1, there is shown a right front perspective, schematic view of the upper body garment in accordance with the invention disposed on a wearer thereof, generally at reference number 100. For convenience, the term jacket is used hereinafter to refer to upper body garment 100 and is intended to include any and all known upper body garments. The jacket chosen for purposes of disclosure and to clearly illustrate the subject matter the inventor considers his invention is an open front jacket. It will be recognized that the novel open bottom pocket as applicable to pullover style (e.g., "closed front") garments and, in point of fact, may be maximally useful in such closed front garments when regions inside the garment are not otherwise readily accessible.

Jacket 100 has an outer surface 102 and an inner surface 104, typically formed from a separate lining fabric layer 114. Jacket 100 has a pair of sleeves 106, only one of which being visible in FIG. 1.

Jacket 100 has a pair of plackets 116 defining a central front opening, not specifically identified.

Reinforced exterior pocket openings 108 provide entry to the open bottom pockets. A reinforced interior region 110 defines an interior opening 112 in lining layer 114 of jacket 100.

Figure 2:
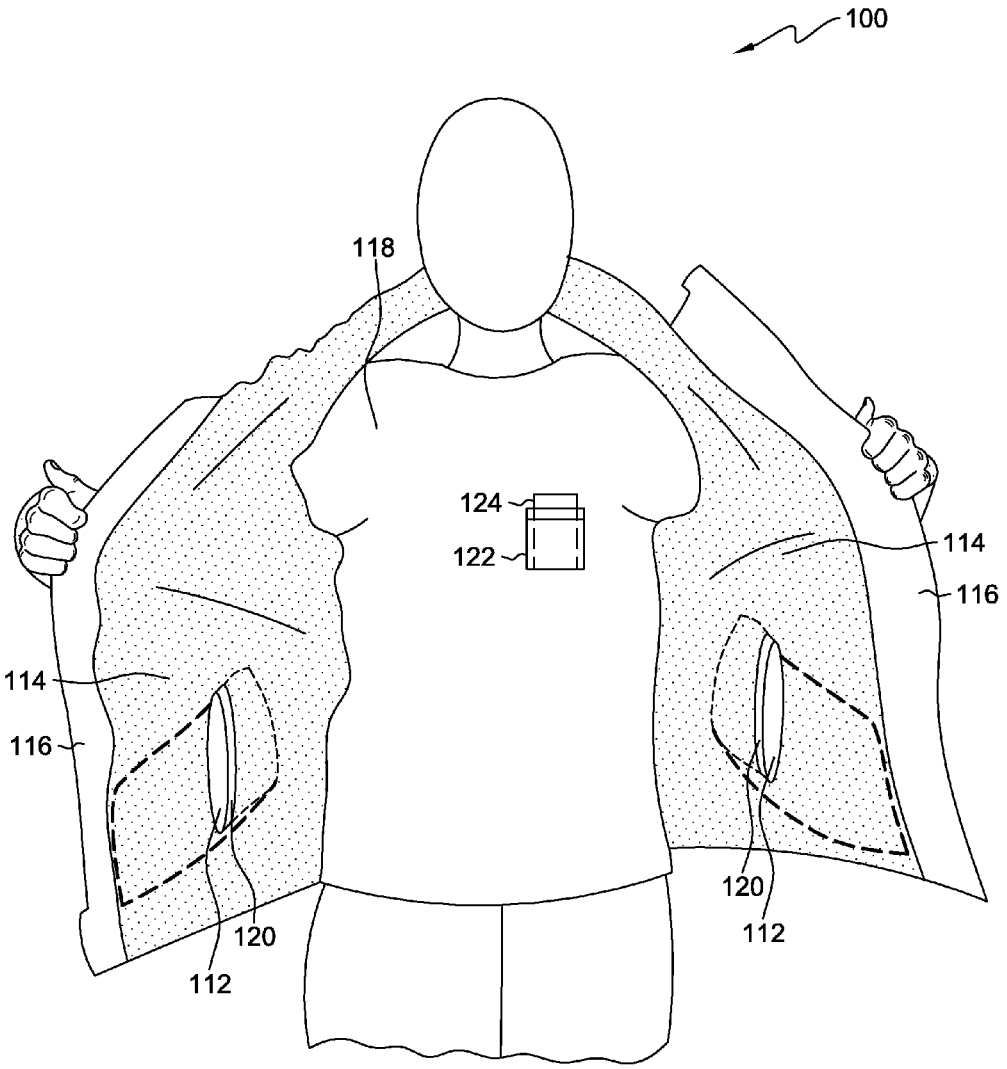
FIG. 2 is a front elevational, schematic of the upper body garment of FIG. 1 showing an inside surface of the garment.

Referring now also to FIG. 2, there is shown a front elevational, schematic view of jacket 100 more clearly showing the inside surface 104. Interior openings 112 of the novel open bottom pockets may be clearly seen.

Also more clearly seen in FIG. 2 is an inside garment (e.g., a tee shirt or the like) 118. Inside garment 118 has a breast pocket 122 holding a cellular phone 124 or other similar device. Inside garment 118, pocket 122, and cellular phone 124 form no part of the invention but are included to illustrate a typical operating environment for the novel open bottom pockets in accordance with the invention.

Figure 3:
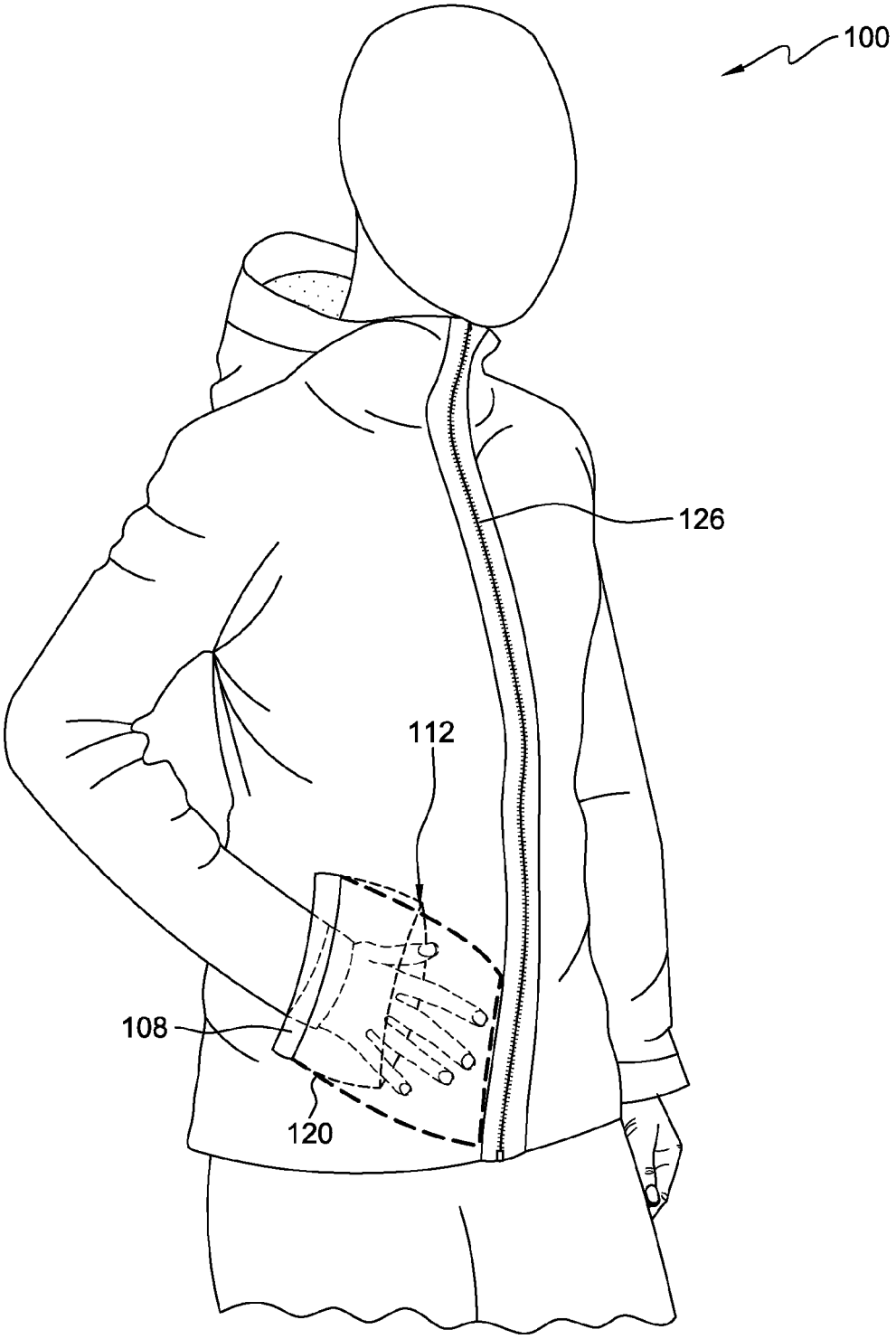
FIG. 3 is a left front perspective view of the garment of FIG. 1 showing a hand of a wearer extending through one of the novel pockets in accordance with the invention.

Referring now also to FIG. 3, there is shown a left front perspective view of jacket 100 with the central opening closed and the right hand of the wearer inserted into external reinforced opening 108 and extending through the novel open bottom pocket, exiting through interior opening 112 into the interior, not specifically identified, of jacket 100.

A "tunnel" 120 is formed between outside reinforced opening 108 and inside opening 112. Tunnel 120 may be formed by stitching between an outer layer, not specifically identified, of jacket 100 and lining 114 or, in alternate embodiments, a fabric tube between the jacket outer layer and lining 114 may form tunnel 120. It will be recognized by those of skill in the art that tunnel 120 could be implemented in many other ways believed known to those of skill in the art. Consequently, the invention is not considered limited to the stitching between an outer layer and the jacket lining or to a fabric tube chosen for purposes of disclosure. Rather, the invention is intended to cover any and all similar methods for forming a tunnel between an outer and an inner opening of the novel bottomless pocket.

Further, while a reinforced outer opening 108 has been chosen for purposes of disclosure, it will be recognized that outer openings without reinforcement could readily be substituted therefor. Consequently, the invention is not considered limited to reinforced outer opening 108 chosen for purposes of disclosure. Rather the invention is intended to include any suitable alternate outer opening.

Also visible in FIG. 3 is a zipper 126, preferably a coil zipper commonly referred to as a nylon zipper. A nylon zipper is advantageous when the wearer of an upper body garment in accordance with the invention that includes a zipper such that when a wearer of the jacket that included such a nylon zipper leans against a finished surface, the likelihood of damage to that finished surface is small. On the other hand, a traditional metal zipper often scratches such surfaces.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is presented in the subsequently appended claims.

What is claimed is:

1. An upper body garment comprising at least one bottomless pocket disposed therewithin, said bottomless pocket comprising an outer opening disposed on an outside surface of said upper body garment, an inside opening disposed on an inside surface of said upper body garment, and a tunnel connecting said outer opening and said inner opening, said outer opening, said inner opening, and said tunnel being sized and configured to allow passage of at least a hand of a wearer of said upper body garment to pass from a region outside said upper body garment, through said tunnel.

2. The upper body garment as recited in claim 1, wherein said outer opening comprises a reinforced outside opening.

3. The upper body garment as recited in claim 1, wherein said tunnel comprises at least one chosen from the group: stitching through at least an outer layer and a lining of said upper body garment disposed between said outer opening and said inner opening, and a fabric tube disposed between said outer opening and said inner opening.

4. The upper body garment as recited in claim 1, wherein said at least one bottomless pocket comprises at least two bottomless pockets.

5. The upper body garment as recited in claim 4, wherein at least one of said at least two bottomless pockets is disposed on a right side of said upper body garment, and at least one of said at least two bottomless pockets is disposed on a left side of said upper body garment.

6. The upper body garment as recited in claim 1, wherein said upper body garment is chosen from the group comprising: a coat, a jacket, a shirt, a sweater, a sweatshirt, and another upper garment type.

7. The upper body garment as recited in claim 6, wherein said upper body garment has a style chosen from the group: an open front upper body garment, and a closed front upper body garment.

8. The upper body garment as recited in claim 7, when said upper body garment is an open front upper body garment, said open front upper body garment further comprises a zipper disposed to selectively join right and left plackets of said upper body garments.

9. The upper body garment as recited in claim 8, wherein said zipper is a coil zipper (i.e., a nylon zipper).

* * * * *